US007690967B2

(12) United States Patent
Makiuchi

(10) Patent No.: US 7,690,967 B2
(45) Date of Patent: Apr. 6, 2010

(54) MOUNTING STRUCTURE FOR MEASURING DEVICE AND GRINDING MACHINE WITH THE STRUCTURE

(75) Inventor: Akira Makiuchi, Anjyo (JP)

(73) Assignee: JTEKT Corporation, Osaka-shi (JP)

( * ) Notice: Subject to any disclaimer, the term of this patent is extended or adjusted under 35 U.S.C. 154(b) by 12 days.

(21) Appl. No.: 11/562,194

(22) Filed: Nov. 21, 2006

(65) Prior Publication Data

US 2007/0135021 A1 Jun. 14, 2007

(30) Foreign Application Priority Data

Dec. 8, 2005 (JP) ..... 2005-354965

(51) Int. Cl.
*B24B 49/00* (2006.01)

(52) U.S. Cl. ..... 451/8; 451/11; 451/26

(58) Field of Classification Search ..... 451/8, 451/9, 11, 25, 26

See application file for complete search history.

(56) References Cited

U.S. PATENT DOCUMENTS

| | | | | | |
|---|---|---|---|---|---|
| 1,941,456 | A | * | 1/1934 | Arnold | 33/556 |
| 2,267,391 | A | * | 12/1941 | Astrowski | 451/25 |
| 2,652,663 | A | * | 9/1953 | Taylor | 451/22 |
| 3,513,601 | A | * | 5/1970 | Fisk | 451/8 |
| 3,603,044 | A | * | 9/1971 | Price | 451/4 |
| 3,663,190 | A | * | 5/1972 | Fisk | 451/8 |
| 3,802,087 | A | * | 4/1974 | Raiteri | 33/555.1 |
| 3,987,552 | A | * | 10/1976 | Raiteri | 33/501.03 |
| 4,606,130 | A | * | 8/1986 | Vetter | 33/501.03 |
| 4,625,413 | A | * | 12/1986 | Possati et al. | 33/802 |
| 4,637,144 | A | * | 1/1987 | Schemel | 33/550 |
| 4,807,400 | A | * | 2/1989 | Corallo et al. | 451/8 |
| 4,811,524 | A | * | 3/1989 | Corallo | 451/9 |
| 5,042,205 | A | * | 8/1991 | Girard et al. | 451/6 |
| 5,086,569 | A | * | 2/1992 | Possati et al. | 33/549 |
| 5,551,906 | A | * | 9/1996 | Helgren | 451/8 |
| 5,761,821 | A | * | 6/1998 | Laycock | 33/555.1 |
| 5,919,081 | A | * | 7/1999 | Hykes et al. | 451/11 |
| 6,067,721 | A | | 5/2000 | Dall'Aglio et al. | |

(Continued)

FOREIGN PATENT DOCUMENTS

EP 1 251 415 A2 10/2002

(Continued)

*Primary Examiner*—Maurina Rachuba
(74) *Attorney, Agent, or Firm*—Oblon, Spivak, McClelland, Maier & Neustadt, L.L.P.

(57) ABSTRACT

In a grinding machine, a bed 10 has secured thereon a work head 11 which rotatably supports a work spindle 12 for supporting a workpiece W and mounts thereon a slide base 15 reciprocatively movable in a Z-direction parallel to the axis of the work spindle, and a wheel head 16 carrying a rotating grinding wheel 17 is reciprocatively movable on the slide base in an X-direction intersecting with the Z-direction. A measuring device 25 for measuring the dimension of the workpiece ground with the grinding wheel is mounted on an extreme end of a support arm 21 secured to the slide base to extend in the X-direction, through an actuator device 23 which is operable for moving the measuring device between a measuring position for engagement with the workpiece and a parked position for disengagement therefrom. The support arm passes over the workpiece, or passes through a space between the bed and the workpiece, or passes through the inside of the bed.

4 Claims, 3 Drawing Sheets

U.S. PATENT DOCUMENTS

| | | | | |
|---|---|---|---|---|
| 6,088,924 | A * | 7/2000 | Esteve | 33/551 |
| 6,159,074 | A * | 12/2000 | Kube et al. | 451/8 |
| 6,298,571 | B1 * | 10/2001 | Dall'Aglio et al. | 33/555.1 |
| 6,430,832 | B1 * | 8/2002 | Dall'Aglio et al. | 33/555.1 |
| 6,643,943 | B2 * | 11/2003 | Dall'Aglio et al. | 33/555.3 |
| 6,955,583 | B2 * | 10/2005 | Dall'Aglio | 451/5 |
| 7,047,658 | B2 * | 5/2006 | Danielli et al. | 33/555.1 |
| 7,048,616 | B1 * | 5/2006 | Gardzinski et al. | 451/49 |
| 2004/0137824 | A1 | 7/2004 | Dall'Aglio | |

FOREIGN PATENT DOCUMENTS

| | | |
|---|---|---|
| JP | 3-52055 | 5/1991 |
| JP | 2601057 | 9/1999 |
| JP | 2000-127038 | 5/2000 |
| JP | 2005-195484 | 7/2005 |

* cited by examiner

MOUNTING STRUCTURE FOR MEASURING DEVICE AND GRINDING MACHINE WITH THE STRUCTURE

INCORPORATION BY REFERENCE

This application is based on and claims priority under 35 U.S.C. 119 with respect to Japanese Application No. 2005-354965 filed on Dec. 8, 2005, the entire content of which is incorporated herein by reference.

BACKGROUND OF THE INVENTION

1. Field of the Invention

The present invention relates to a mounting structure for a measuring device which measures the dimension of a ground portion for performing a grinding while controlling the dimension of the ground portion. Particularly, it relates to a mounting structure for a measuring device which is designed for use in a cylindrical grinding machine. Further, the present invention relates to a grinding machine with the mounting structure.

2. Discussion of the Related Art

Cylindrical grinding machines generally take the construction that a bed has mounted thereon a work head having a work spindle for rotatably supporting and driving a workpiece and a wheel head having a rotating grinding wheel and that the work head and the wheel head are relatively moved in a Z-direction parallel to the rotational axis of the work spindle and an X-direction perpendicular thereto to grind the workpiece. Such cylindrical grinding machines are classified into a table traverse type that the grinding operation is performed by moving a table with the work head fixed thereon on the bed in the Z-direction and by moving the wheel head on the bed in the X-direction and a wheel head traverse type that the grinding operation is performed by moving the wheel head relative to the work head fixed on the bed in two directions of Z and X. The table traverse type has heretofore been the mainstream of cylindrical grinding machines, wherein the length of the machine in the Z-direction becomes long because a table elongated in the Z-direction is moved in the Z-direction. However, these days the wheel head traverse type is becoming the mainstream of cylindrical grinding machines because of an increasing demand for the downsizing of the machines. In the wheel head traverse type, it is general to take the construction that the wheel head is mounted movably in the X-direction on a slide base which is mounted movably on the bed in the Z-direction.

In the table traverse type, on the contrary, it is ordinary to mount a measuring device on a pillar upstanding at a front portion of the bed which is adjacent to the grinding wheel in the Z-direction and which is on the side opposite to the grinding wheel in the X-direction. With this construction taken, it does not occur that the grinding wheel and the measuring device are moved relatively in the Z-direction even when the workpiece is moved relative to the grinding wheel in the Z-direction. Therefore, any ground portion on the workpiece can be measured at all times by the measuring device remaining in front of the grinding wheel, so that a mounting structure for the measuring device can be simplified. By the way, in cylindrical grinding machines, an opening which can be selectively opened for the loading/unloading of the workpiece as well as for the maintenance of attachments provided in a grinding area is provided at a front part of a cover for preventing coolant supplied to the grinding area from splashing. In the aforementioned mounting structure for the measuring device, since the same is arranged around the opening portion of the cover, there arises a problem in that the mounting structure becomes an obstacle in performing the loading/unloading of the workpiece and the maintenance of the attachments. For the purpose of solving the problem, it has been practiced to arrange the measuring device at an end part of the opening portion or at a part being within the cover but being deviated from the opening portion, in which case a resultant problem arises in that the adjustment and maintenance of the measuring device per se becomes difficult to perform.

In the wheel head traverse type, on the other hand, it is first conceivable to mount the measuring device on the bed. With this structure taken, the measuring device cannot be moved relative to the workpiece, and thus, where grinding operations are to be performed on ground portions of a workpiece which are spaced at plural places in the Z-direction, measuring devices for the respective ground portions have to be provided, resulting in an increase in the facility cost. Further, where workpieces respectively having ground portions at different positions in the Z-direction are to be ground in succession, there arises an inconvenience that the position of the measuring device has to be changed each time of one grinding operation. Further, like the table traverse type as aforementioned, there arises a problem that the measuring device positioned at the opening portion of the cover makes an obstacle against the maintenance and adjustment of various attachments therearound. As a measure for solving these problems, there have been known a structure that a measuring device is mounted movably in the Z-direction on a bed or a member such as a table mounting a work head thereon and another structure that a measuring device is mounted on a wheel head.

The structure that the measuring device is mounted movably in the Z-direction is disclosed in Japanese Utility Model No. 2601057 for example. In the know structure, as shown in FIGS. 1 to 3 of the Japanese Utility Model, a slide table 6 is mounted movably in the axial direction of a work spindle 3*a* on a table 2, which mounts thereon a work head 3 and a foot stock 4 for supporting a workpiece W, on a side opposite to the side where the machining of the workpiece W is performed, and the slide table 6 is provided with a servomotor 11 driven in response to a signal designating the workpiece or a measuring position on the workpiece W and a conversion mechanism 14-19 for converting the rotation of the servomotor 11 into the reciprocating movement of the slide table 6, wherein a measuring device main body 10 is secured on the slide table 6. With this structure, it can be realized to automatically move the measuring device main body 10 to any programmed measuring position on the workpiece W, and it becomes possible to evacuate the measuring device main body 10 to a suitable position where the measuring device main body 10 does not interfere with the loading/unloading of the workpiece and the maintenance for attachments provided in the grinding area.

Further, the structure for mounting the measuring device on the wheel head is disclosed in Japanese Unexamined, Published Patent Application No. 2000-127038. As shown in FIGS. 1 and 2 of the Japanese Application, the application relates to a grinding machine with twin wheel heads 8, 9, wherein measuring devices 20 are mounted on the top surfaces of the respective wheel heads 8, 9. More specifically, each wheel head mounts a support member 21 for the measuring device 20 on the top surface thereof, a second arm 23 is pivotably carried at an extreme end of a first arm 22 which is pivotably carried by the support member 21 to extend forward, and a measuring rod 28 for measuring dimensions is secured approximately at right angles to an extreme end of the second arm 23. The measuring rod 28 is composed of a V-block 25 secured at an extreme end thereof and contactable with the outer surface of a crankpin CP to be machined and a probe 27 provided at the center part of the V-block 25 to be movable back and forth and electrically detects the back and forth movement of the probe 27 to output the detected movement as an electric signal. The measuring device 20 is provided with an actuator or hydraulic cylinder 31 for moving the measuring rod 28 selectively to a parked position and a measuring position. In the measuring device 20, the hydraulic cylinder 31 turns the first arm 22 upward to hold the measuring rod 28 at the parked position as indicated by the phantom line in FIG. 2 of the Japanese application, in which state the second arm 23 pivotable about the extreme end of the first arm 22 would not be held at a fixed position. With this taken into account, a third arm 24 is secured to the extreme end of the first arm 22 to extend downward, and a support protrusion 29 at the extreme end of the third arm 24 holds the second arm 23 at the fixed position while the measuring device 20 is at the parked position. The measuring device 20 needs a complicated link mechanism as aforementioned for the purpose of holding the V-block 25 and the probe 27 in contact with the outer surface of the crankpin CP to be ground, in a predetermined relation even though the wheel head 9 is moved in the X-direction during each grinding operation.

As described above, in the wheel head traverse type, the structure that mounts the measuring device on the member supporting the work head, to be movable in the Z-direction requires the slide table, the servomotor for operating the same and the conversion mechanism for converting the motor rotation into the reciprocating movement of the slide table and thus, unavoidably results in a substantial increase in the facility cost. Further, in the wheel head traverse type, the structure that mounts the measuring device on the wheel head requires the complicated link mechanism as aforementioned and thus, also unavoidably results in an increase in the facility cost. In addition, the link mechanism needs considerable rigidity for higher measuring accuracy of the measuring device and is increased also in weight. Because this results in further increasing the weight exerted on the top surface of the wheel head which is supported to be movable in the X-direction on the slide base which is in turn supported on the bed to be movable in the Z-direction, there is a risk of deteriorating the feed accuracy and the positioning accuracy of the wheel head. Further, the addition of the large weight mechanism to a high position may have a risk of generating chattering vibration. Furthermore, since electric wires and hydraulic conduits for the measuring device suffer bending and stretching in two directions of Z and X, there arises an additional problem involving a risk of breaking or damaging the electric wires and the hydraulic conduits.

SUMMARY OF THE INVENTION

It is therefore a primary object of the present invention to provide an improved mounting structure for a measuring device, capable of solving the aforementioned problems involved in the prior art.

Briefly, according to the present invention, there is provided a mounting structure for a measuring device in a grinding machine having a work head fixed on a bed for rotatably supporting a work spindle which supports and rotates a workpiece, a slide base mounted on the bed and reciprocatively movable in a Z-direction, a wheel head mounted on the slide base and reciprocatively movable in an X-direction intersecting with the Z-direction, a rotating grinding wheel carried on the wheel head for grinding a ground portion of the workpiece, and a measuring device engageable with the ground portion of the workpiece ground with the grinding wheel for measuring the dimension of the ground portion. The mounting structure comprises a support arm secured to the slide base and extending its extreme end in the X-direction to a position which is opposite to the grinding wheel with the rotational axis of the work spindle therebetween; and a mechanism provided on the extreme end of the support arm and mounting the measuring device for enabling the measuring device to be brought into engagement with the workpiece from a side opposite to the grinding wheel.

With this construction, since the support arm secured to the slide base extends in the X-direction to the position opposite to the grinding wheel with the rotational axis of the work spindle therebetween and since the measuring device is mounted on the extreme end of the support arm to be brought into engagement with the workpiece from the side opposite to the grinding wheel, the measuring device is movable together with the grinding wheel in the Z-direction and is kept to face with the grinding wheel in a predetermined positional relation at all times. In addition, being independent of the movement of the wheel head in the X-direction, the measuring device does not move relative to the workpiece in the X-direction despite the movement in the X-direction of the grinding wheel. Accordingly, it is possible for the measuring device to correctly engage at all times with the ground portion of the workpiece being ground with the grinding wheel and hence to measure the dimension of the ground portion precisely. Further, since the measuring device is mounted on the extreme end of the support arm fixed on the slide base and since any motion synchronizing mechanism is not required to be provided between the measuring device and the slide base or the wheel head, the mounting structure can be practiced at a quite less facility cost. Further, because any additional or superfluous weight is not exerted on the wheel head which is supported on the slide base movably in the X-direction, there is neither a risk of deteriorating the feed accuracy and the positioning accuracy of the wheel head in the X-direction, nor a risk of causing the wheel head to generate chattering vibration as a result of a heavy weight object being provided at a high position. Further, it is possible for the measuring device not to serve as an obstacle in performing the loading/unloading of a workpiece and the maintenance of attachments through an opening provided at a front part of a cover surrounding a grinding area, and it is also possible to move the measuring device to a position where the loading/unloading of a workpiece and the maintenance of the attachments become easy to perform. Further, since electric wires and hydraulic conduits for the measuring device suffer bending and stretching in the Z-direction only, there is decreased a risk of breaking or damaging the electric wires and the hydraulic conduits.

In another aspect of the present invention, there is provided a grinding machine which comprises a bed, a work head fixed on the bed, a work spindle rotatably supported by the work head for supporting and rotating a workpiece, a slide base mounted on the bed and reciprocatively movable in a Z-direction, a wheel head mounted on the slide base and reciprocatively movable in an X-direction intersecting with the Z-direction, a rotating grinding wheel carried on the wheel head for grinding a ground portion of the workpiece, and a measuring device engageable with the ground portion of the workpiece ground with the grinding wheel for measuring the dimension of the ground portion. The grinding machine further comprises a support arm secured to the slide base and extending its extreme end in the X-direction to a position which is opposite to the grinding wheel with the rotational axis of the work spindle therebetween and a mechanism provided on the extreme end of the support arm and mounting the measuring device for enabling the measuring device to be brought into engagement with the workpiece from a side opposite to the grinding wheel.

With this construction, the same advantages as described in connection with the aforementioned mounting structure can also be achieved in the grinding machine.

BRIEF DESCRIPTION OF THE DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which.

DETAILED DESCRIPTION OF THE PREFERRED EMBODIMENTS

First Embodiment

Figure 1:
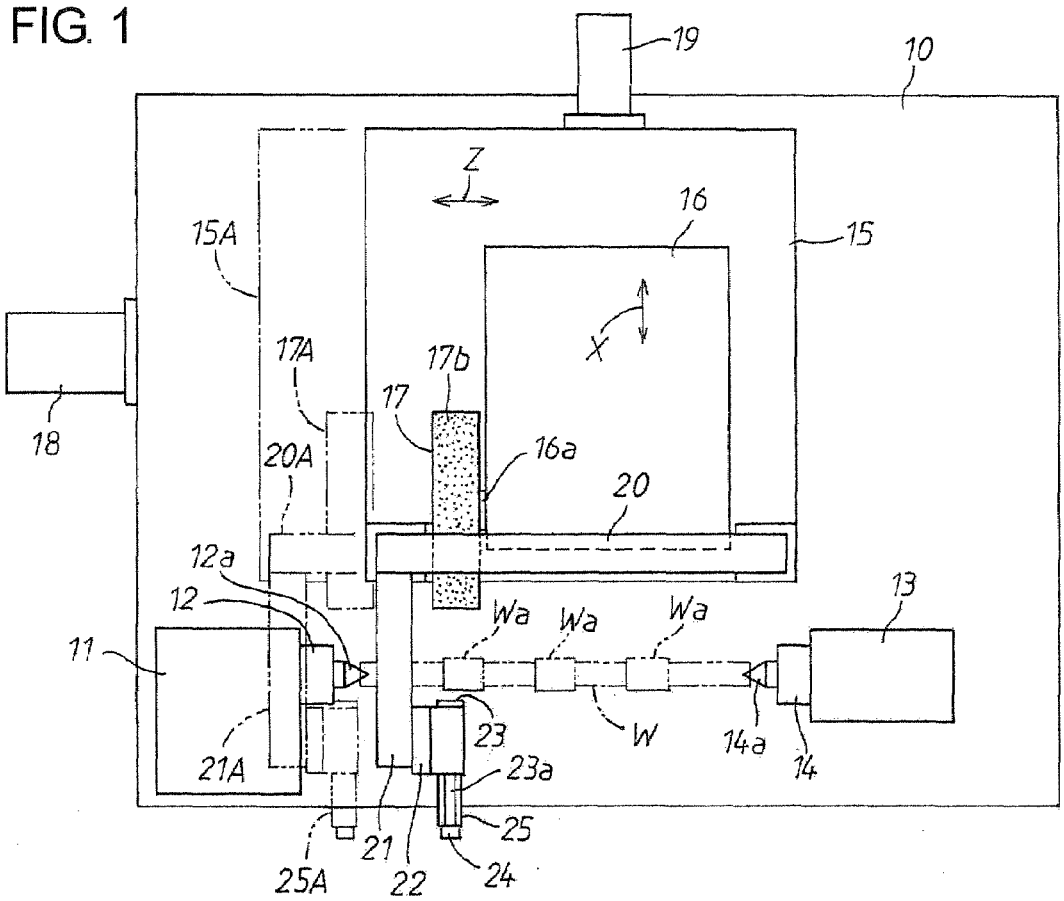
FIG. 1 is a schematic plan view showing the overall construction of a cylindrical grinding machine with a mounting structure for a measuring device in a first embodiment according to the present invention.
Figure 2:
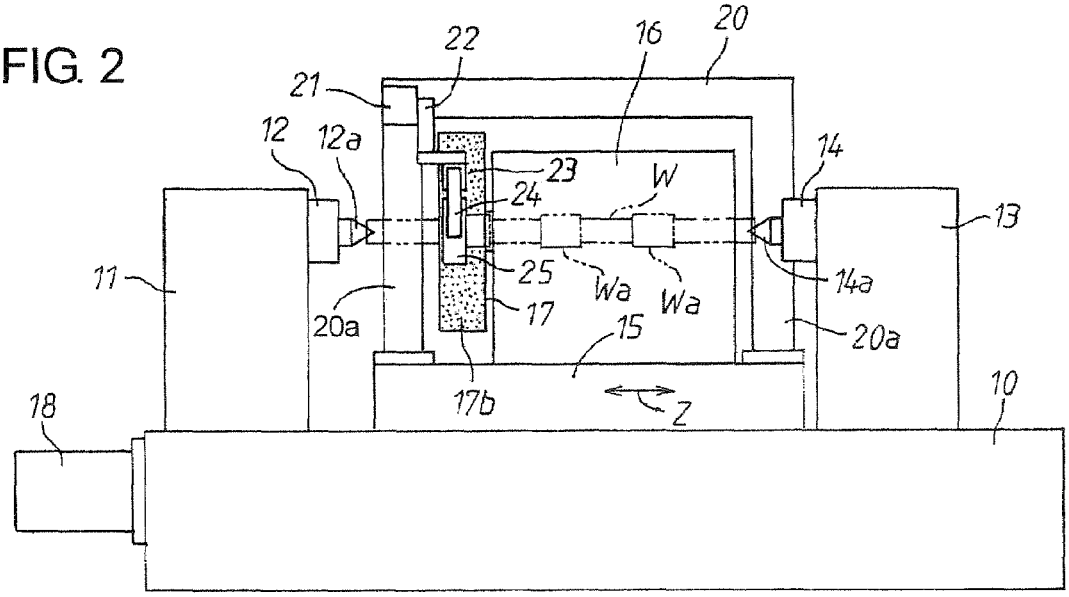
FIG. 2 is a front view of the cylindrical grinding machine shown in FIG. 1.
Figure 3:
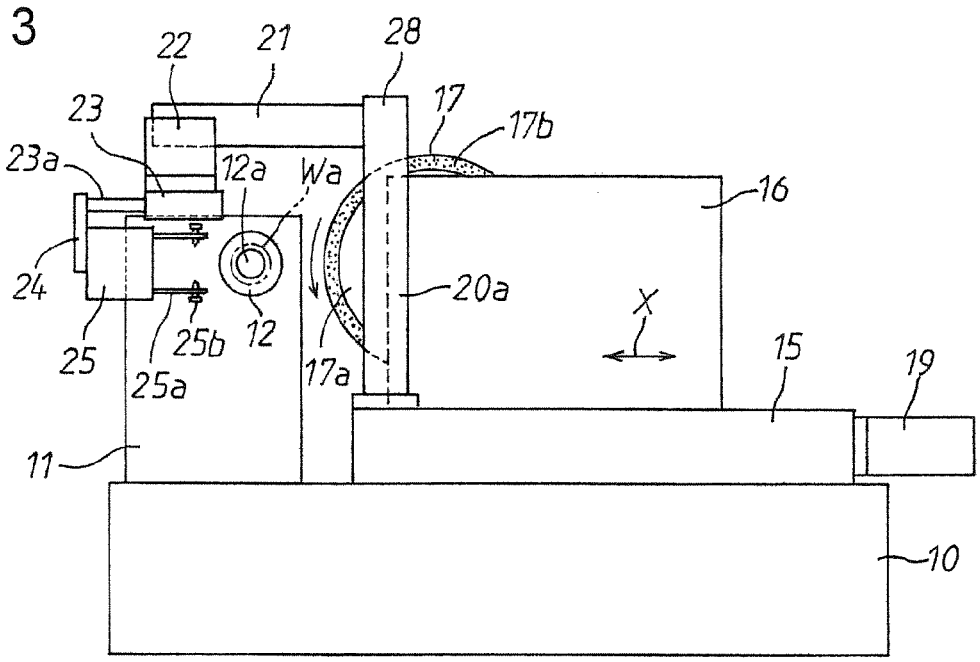
FIG. 3 is a right side view of the cylindrical grinding machine shown in FIG. 1 with a foot stock being omitted from illustration.

FIGS. 1 to 3 show the overall construction of a cylindrical grinding machine with a mounting structure for a measuring device in a first embodiment according to the present invention. Referring to FIGS. 1 to 3, a work head 11 and a foot stock 13 are arranged and fixed on a front part (the lower side as viewed in FIG. 1) of a bed 10 of the cylindrical grinding machine to face with each other in a horizontal left-right direction (Z-direction). A work spindle 12 with a work spindle center 12*a* secured thereto coaxially is rotatably carried in the work head 11 to be drivingly rotatable by a motor (not shown), while a foot stock shaft 14 with a foot stock center 14a secured thereto coaxially is carried in the foot stock 13 to be moved back and forth and is arranged in axial alignment with the work spindle 12 whose rotational axis extends in parallel to the Z-direction. A workpiece W with a plurality of ground portions Wa thereon is supported at its opposite ends by means of the centers 12*a*, 14*a* through center holes formed on the opposite end surface of the workpiece W. The workpiece W is engageable with a driving member (not shown) provided on the work spindle 12 and is rotatable together with the work spindle 12.

At a part thereof behind the work head 12 and the foot stock 14, the bed 10 guides and supports a slide base 15 along guide rails (not show) to be movable in the Z-direction and is reciprocatively driven by a Z-axis servomotor 18 through a screw shaft (not shown). A wheel head 16 is mounted on a flat top surface of the slide base 15 to be movable along guide rails (not shown) in an X-direction perpendicular to the Z-direction and is reciprocatively driven by an X-axis servomotor 19 through a screw shaft (not shown). At one side adjacent to the work head of the front part of the wheel head 16, a grinding wheel 17 composed of a disc-like wheel core 17*a* and a grinding wheel layer 17*b* on the circumference thereof is supported through a grinding wheel spindle 16a parallel to the Z-direction to be drivingly rotatable by a grinding wheel motor (not shown) and is partly protruded from the front surface of the wheel head 16 toward the front side or the workpiece W side.

As best shown in FIG. 2, a gantry-like support frame 20 of an inverted U-letter shape straddles over the wheel head 16 and the grinding wheel 17 with suitable spaces relative thereto and is secured at the lower ends of its leg portions 20*a* to front opposite side parts on the top surface of the slide base 15. A support arm 21 is secured at its one end to an upper part on the work head 11 side of the support frame 20 and horizontally extends forward over the workpiece W being supported by the work spindle 12 and the foot stock 13 to make its extreme end reach a position which is beyond the rotational axis of the work spindle 12. The extreme end of the support arm 21 is provided on a lower side with an actuator device 23 which is offset toward the wheel head 16 side in the Z-direction, through a bracket 22 taking an L-letter shape in cross-section, as shown in FIG. 2. The actuator device 23 in the first embodiment comprises a gas or air cylinder device 23 which has a piston rod 23*a* extensible toward the front side in the X-direction. A measuring device 25 arranged under the cylinder device 23 is suspended from an extreme end of the piston rod 23*a* through a support piece 24, and a pair of upper end lower feelers 25*a* of the measuring device 25 are protruded toward the workpiece W side at a position facing with the grinding wheel 17. The measuring device 25 is movable by the operation of the cylinder device 23 back and forth between a measuring position where contact portions 25*b* of the extreme ends of the respective feelers 25*a* are engaged with a ground portion Wa of the workpiece W at two diametrically spaced points on the side opposite to the grinding wheel 17 and a parked position where the contact portions 25*b* are retracted from the measuring position toward the side opposite to the grinding wheel 17. In a modified form, the extending direction of the support arm 21 may be somewhat inclined relative to the X-direction in the horizontal direction and the vertical direction. Further, the direction in which the piston rod 23*a* of the cylinder device 23 moves may also be somewhat inclined in the vertical direction. In addition, the actuator device 23 is not limited to cylinder devices, instead of which the measuring device 25 may be moved back and forth by an electric motor or the like.

(Operation)

The operation of the first embodiment as constructed above will be described hereafter. In an inoperative state, as shown in FIGS. 1 and 3, the grinding wheel 17 has been separated by the X-axis servomotor 19 backward from the workpiece W, the measuring device 25 has been moved by the cylinder device 23 to the parked position where it has been disengaged from a ground portion Wa, the slide base 15 has been moved by the Z-axis servomotor 18 to a position indicated by the phantom line 15A shown in FIG. 1, the grinding wheel 17, the support frame 20, the support arm 21 and the measuring device 25 have been moved toward the work head 11 side (i.e., to an evacuated position) respectively indicated by the phantom lines 17A, 20A, 21A and 25A in FIG. 1, and the foot stock shaft 14 has been retracted. In this state, the workpiece W is loaded downward by a loading/unloading device (not show)

from a retracted position over the grinding machine and is putted on temporarily support members (not shown) provided on the bed 10, as well known in the art. Then, the foot stock shaft 14 is advanced to support the opposite ends of the workpiece W by means of both centers 12*a*, 14*a* while lifting up the workpiece W a minute amount from the temporarily support members, as well known in the art.

When the work spindle 12 is then drivingly rotated by the work spindle motor (not shown), the workpiece W in driving engagement with the driving member on the work spindle 12 is rotated bodily with the work spindle 12. In this state, the slide base 15 is moved by the Z-axis servomotor 18 in the Z-direction to bring the grinding wheel 17 into alignment with one ground portion Wa of the workpiece W, and the wheel head 16 is then advanced by the X-axis servomotor 19 at a rapid feed rate in the X-direction to make the grinding wheel 17 approach the ground portion Wa. Thereafter, the feed rate of the wheel head 16 in the X-direction is reduced on step-by-step basis to perform a rough grinding, a medium grinding, a fine grinding and a minute grinding in a continuous manner. Prior to or for the fine grinding and the minute grinding, the measuring device 25 is advanced by the cylinder device 23 to be brought into the measuring position, whereby the contact portions 25*b* at the extreme ends of the respective feelers 25*a* are engaged with the ground portion Wa of the workpiece W at two diametrically spaced points to continuously measure the diameter of the ground portion Wa being under the grinding operation. Thus, the grinding is performed so that the plunge feed amount of the grinding wheel 17 by the X-axis servomotor is controlled based on the measuring result, that is, in response to a measuring signal from the measuring device 25, and the ground portion Wa is finished to a predetermined dimension. Upon completion of the grinding on one ground portion Wa, the wheel head 16 is once retracted, and the slide base 15 is moved by the Z-axis servomotor 18 in the Z-direction to bring the grinding wheel 17 into alignment with the next ground portion Wa on the workpiece W, in which state the grinding of the next ground portion Wa is performed in the same manner as described above. These control steps are repeated, whereby all of the ground portions Wa on the workpiece W are ground. The measuring of each ground portion Wa by the measuring device 25 may be performed also during the rough grinding and the medium grinding.

Upon completion of the grindings on all of the ground portions Wa, the measuring device 25 is retracted to the parked position, and as indicated by the phantom lines 17A, 20A, 21A and 25A, the grinding wheel 17 is retracted backward as well as toward the left to move the measuring device 25 and other movable members toward the work head 11 side to the evacuated position. Thereafter, the work spindle 12 is stopped, and the foot stock shaft 14 is retracted to cause the finished workpiece W to be put on the temporary support members. Then, the finished workpiece W is replaced with an unfinished one by hand or the loading/unloading device, and the unfinished workpiece W is ground in the same manner as described above. It is possible to perform the foregoing grinding operations manually by hand or automatically under the control of, e.g., a CNC controller (not shown), as well known in the art.

In the foregoing first embodiment, the measuring device 25 mounted on the slide base 15 through the support frame 20, the support arm 21 and the cylinder device 23 is moved together with the grinding wheel 17 in the Z-direction to face with the grinding wheel 17 in a predetermined positional relation at all times and does not move in the X-direction despite the movement in the X-direction of the wheel head 16. Accordingly, it can be realized to bring the measuring device 25 by the cylinder device 23 into the measuring position whenever desired, and to precisely measure the dimension of any ground portion Wa of the workpiece W being ground with the grinding wheel 17 with itself being held in contact with any such ground portion Wa properly. Further, although the measuring device 25 is mounted through the cylinder device 23 on the extreme end of the support arm 21 fixed on the slide base 15, the cylinder device 23 suffices to be that of a simplified construction which enables the measuring device 25 to be moved between two positions. Thus, any motion synchronizing mechanism is not required to be provided between itself and the slide base 15 or the wheel head 16, so that the mounting structure in the first embodiment can be practiced at a quite less facility cost.

Although the support frame 20 and the support arm 21 which support the cylinder device 23 and the measuring device 25 require to be considerably high in rigidity for higher measuring accuracy and hence, to be considerably heavy in weight, these members are all mounted on the slide base 15 and do not apply their weights on the wheel head 16 carrying the grinding wheel 17. Accordingly, there is neither a risk of deteriorating the feed accuracy and the positioning accuracy of the wheel head 16 in the X-direction, nor a risk of causing the wheel head 16 to generate chattering vibration as a result of a heavy weight object being provided at a high position, so that there is no risk of badly affecting the machining accuracy.

Further, in cylindrical grinding machines, it has been a practice that a cover which surrounds the circumference of a grinding area is provided with an opening which can be selectively opened for the purposes of the loading/unloading of a workpiece and the maintenance of attachments such as rest devices and the aforementioned temporary support members and the like. However, in the present embodiment, since the measuring device 25 movable together with the slide base 15 in the Z-direction can be provided at a position which is deviated from such an opening, it is possible for the measuring device 25 not to serve as an obstacle in performing the loading/unloading of a workpiece and the maintenance of the attachments, and it is also possible to bring the measuring device 25 into a position (e.g., the evacuated position) where the loading/unloading of the workpiece and the maintenance of the attachments becomes easy to perform through such an opening. Further, electric wires and hydraulic conduits for the measuring device 25 suffer bending and stretching in the Z-direction only, but do not suffer bending and stretching in the X-direction, so that a risk is decreased of breaking or damaging the electric wires and the hydraulic conduits.

In the foregoing first embodiment, the support arm 21 supporting the cylinder device 23 and the measuring device 25 is provided to pass over the workpiece W being supported between the work spindle 12 and the foot stock shaft 14. With this construction, the mounting of the measuring device 25 becomes easy, because there is decreased a risk that the support arm 21 interferes with the attachments such as the temporary support members, a workpiece rest device for supporting the workpiece W against the grinding resistance, a truing device for truing the grinding wheel 17 and the like which are provided on the bed 10 close to the workpiece W. The loading/unloading device for loading and unloading the workpiece W from the upper side of the grinding machine involves a risk of dropping the workpiece W erroneously on the measuring device 25 provided thereunder in the course of its operation. In the foregoing first embodiment, however, because the support arm 21 being considerably high in rigidity is provided to pass over the workpiece W supported between the work spindle 12 and the foot stock shaft 14, the workpiece W when so dropped comes to first hit against the support arm 21 in many cases, so that there is decreased a risk that the dropping workpiece W hits directly against the measuring device 25 to damage the same.

Further, in the foregoing first embodiment, the gantry-like support frame 20 which straddles over the wheel head 16 and the grinding wheel 17 with a space relative thereto is fixed on the front opposite side pats of the upper surface of the slide base 15 at the lower ends of its leg portions 20*a*, and the support arm 21 which supports the cylinder device 23 and the measuring device 25 extends in the X-direction with its one end secured to the upper portion on the work head 11 side of the support frame 20. With this construction, since the gantry-like support frame 20 can be sufficiently large in rigidity, the mounting structure including the support arm 21 for the measuring device 20 also becomes large as a whole in rigidity, so that it can be realized to enhance the accuracy at which the measuring device 25 measures the dimension of the ground portion Wa. However, the present invention is not limited to this structure and may be practiced in the form that the support arm 21 extending in the X-direction is secured to the upper end of a single support pillar which is provided upstanding on the slide base 15 on the work head 11 side and that the cylinder device 23 and the measuring device 25 are supported at the extreme end of the support arm 21.

Although in the foregoing embodiment, description has been made regarding an example wherein the support arm 21 supporting the cylinder device 23 and the measuring device 25 is provided to pass over the workpiece W, the present invention is not limited to such an example. For example, the present invention may be practiced in the form that the support arm 21 extends in the X-direction to pass through the space between the upper surface of the bed 10 and the workpiece W or through the inside of the bed 10.

Second Embodiment

Figure 4:
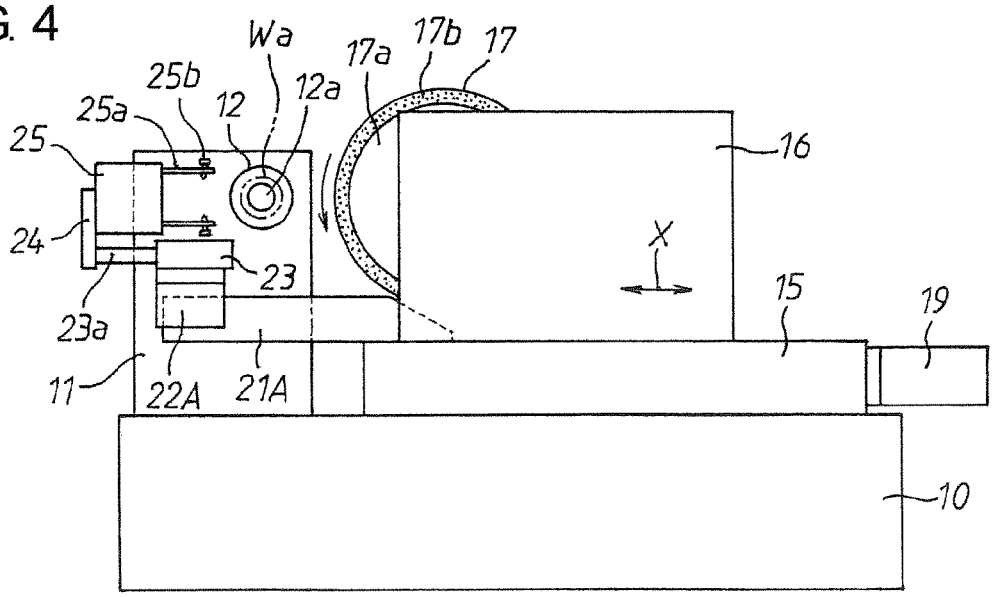
FIG. 4 is a right side view corresponding to FIG. 3 of a cylindrical grinding machine with a mounting structure for a measuring device in a second embodiment according to the present invention.

FIG. 4 shows a second embodiment wherein a support arm 21A extends in the X-direction to pass through the space between the upper surface of the bed 10 and the workpiece W. The support arm 21A which is secured to a front portion on the work head 11 side of the upper surface of the slide base 15 and which horizontally extends forward in the X-direction has its extreme end reaching a position which is beyond the rotational axis of the work spindle 12, and the cylinder device 23 is provided above the extreme end through the bracket 22 taking an L-letter shape in cross-section. The measuring device 25 arranged over the cylinder device 23 is supported on the extreme end of the piston rod 23*a* through the support piece 24, and the pair of upper and lower feelers 25*a* of the measuring device 25 are protruded toward the workpiece W side on a position facing with the grinding wheel 17. The cylinder device 23, the support piece 24 and the measuring device 25 are same as those used in the foregoing first embodiment, and the measuring device 25 is moved by the cylinder device 23 back and forth between the measuring position and the parked portion in the same manner as described in the first embodiment.

In the second embodiment as constructed above, it can be realized to make the structure light in weight, because the support arm 21A supporting the measuring device 25 becomes short in length and because the mounting structure for the measuring device 25 becomes small in the whole dimension. Further, it can be realized to avoid the interference with the workpiece loading/unloading device which is provided on an upper side of the grinding machine. In the second embodiment, since the support arm 21A and the like which are moved together with the slide base 15 would come to interfere with the attachments such as the temporary support members, the workpiece rest device, the truing device and the like which are all provided on the bed 10 if these attachments on the bed 10 were used as they are, that is, in the form as used in the foregoing first embodiment. Therefore, it is necessary to modify these attachments to take respective shapes each of which does not interfere with the support arm 21A and the like moving in the Z-direction. Otherwise, it is necessary to provide these attachments in such a way that they are retractable into the bed 10 to prevent the interference with the support arm 21A from taking place.

Third Embodiment

Figure 5:
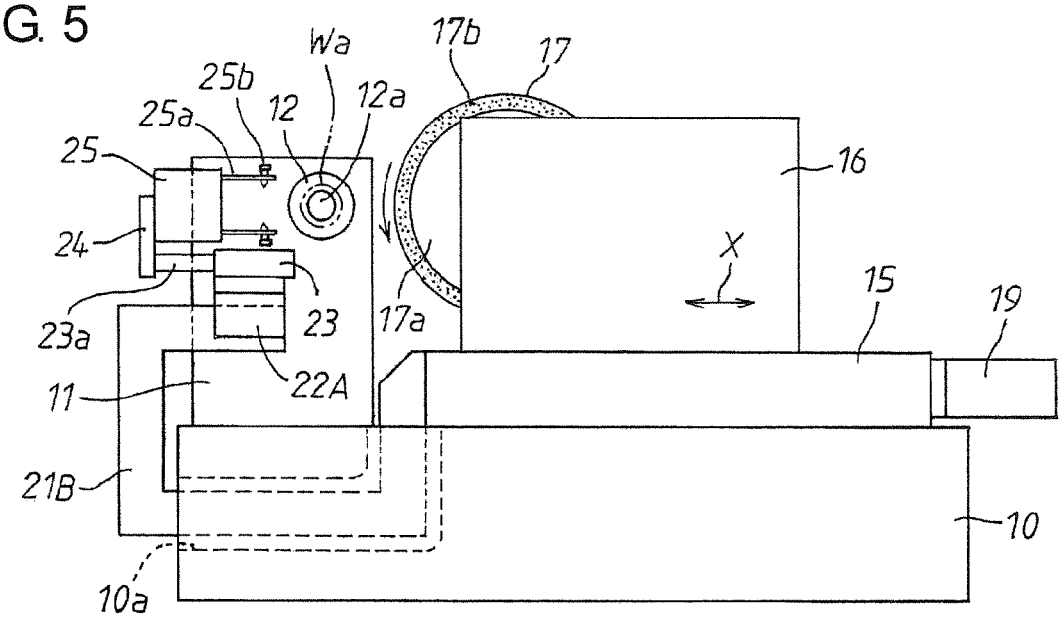
FIG. 5 is a right side view corresponding to FIG. 3 of a cylindrical grinding machine with a mounting structure for a measuring device in a third embodiment according to the present invention.

FIG. 5 shows a third embodiment in which the support arm 21B extends in the X-direction to pass through the inside of the bed 10. The bed 10 has formed therein a wide pathway 10*a* which passes through the inside of the front upper part of the bed 10. Specifically, the wide pathway 10*a* opens at the upper surface of the bed 10 in the neighborhood of the front end portion of the slide base 15, extends first downward and then in the X-direction to pass under the workpiece W and opens on the front surface of the bed 10. That is, the pathway 10*a* takes an L-letter shape in cross-section along the X-direction to pass under the front upper part of the bed 10 which part is under the rotational axis of the work spindle 12. The width of the pathway 10 in the Z-axis direction is made wider by the width in the Z-direction of the support arm 21B than the moving stroke in the Z-direction of the slide base 15. The support arm 21B is secured to a front end surface on the work head 11 side of the slide base 15, comes into the pathway 10*a* by being extended downward, then is bent forward in the X-direction to extend in the X-direction, is then bent upward after coming out of the front end surface of the bed 10, and is further bent horizontally to reside over the front upper surface of the bed 10. Above the last or horizontally bent part of the support arm 21B, the cylinder device 23 is provided through the bracket 22A taking an L-letter shape in cross-section, in the same manner as that used in the foregoing second embodiment. The measuring device 25 arranged over the cylinder device 23 is supported on the extreme end of the piston rod 23*a* through the support piece 24, and the pair of upper and lower feelers 25*a* of the measuring device 25 are protruded toward the workpiece W side to the position facing with the grinding wheel 17. The measuring device 25 is moved by the cylinder device 23 back and forth between the measuring position and the parked portion in the same manner as described in the first and second embodiments.

In the third embodiment as constructed above, the increase in the facility cost to some degrees is unavoidable because the pathway 10*a* has to be formed inside the bed 10 and because the support arm 21B becomes complicated in shape. However, by making the support arm 21B pass through the pathway 10*a* formed inside the bed 10, it becomes possible to avoid the interference with the workpiece loading/unloading device provided over the workpiece W as well as with the attachments provided on the bed 10, so that in this respect, the third embodiment becomes easy to practice.

Although in the foregoing embodiments, description has been made taking as an example a plunge grinding method in which after the slide base 15 is selectively positioned in the Z-direction, the wheel head 16 is advanced in the X-direction to perform the grinding of each ground portion Wa on the workpiece W, the present invention is not limited to be practiced in the plunge grinding method. That is, the present invention may be practiced in a traverse grinding method in which after the position of the wheel head 16 in the X-direction is determined, the slide base 15 is moved in the Z-direction to perform a grinding operation on a workpiece, in which case the measuring device 25 is moved to measure the diameter of a portion right after the same is ground with the grinding wheel 17. Furthermore, the present invention is not limited to the grinding of the outer surface of a workpiece W, but may be applicable to the case where the diameter of an internal surface finished through an internal surface grinding is measured by the use of a measuring device designed for inner diameter measurement. Alternatively, the present invention may also be applicable to the case where the width of a stepped portion such as a flange whose axial opposite end surfaces are finished through end surface grindings is measured by a measuring device for width measurement.

Further, although in the foregoing embodiment, description has been made regarding an example in which the measuring device 25 uses two feelers 25*a*, the present invention is not limited to the measuring device 25 of this type. For example, as disclosed in the foregoing Japanese application No. 2000-127038, the present invention may be practiced by using a measuring device of a different type such as that which is composed of a V-block contactable to the outer surface of a ground portion and a probe provided at the center part of the V-block to be movable back and forth for detecting the diameter of the same outer surface upon contact, as disclosed in the foregoing Japanese application No. 2000-127038.

Further, although in the foregoing embodiments, description has been made regarding an example wherein the Z-direction parallel to the rotational axis of the work spindle 12 intersects perpendicularly to the X-direction in which the wheel head 16 is fed, the present invention is not limited to the orthogonal arrangement between the Z and X-directions. Instead, the present invention may be applicable to a grinding machine in which the Z-direction and the X-direction do not extend at right angles. Further, although in the foregoing embodiments, description has been made regarding the case where the rotational axis of the grinding wheel 17 extends in parallel to the Z-direction, the present invention is not limited to that case, but may rather be applicable to a grinding machine in which the rotational axis of the grinding wheel 17 is not parallel to the Z-direction.

Moreover, although in the foregoing embodiment, description has been made taking an example wherein the workpiece W is supported by means of the pair of centers 12*a*, 14*a*, the present invention is not limited to the manner of supporting the workpiece W. In a further modified form, the present invention may be applicable to the case where the grinding is performed with a workpiece being supported in a cantilever fashion by a chuck provided on the work spindle 12 without using the foot stock 13.

Obviously, numerous further modifications and variations of the present invention are possible in light of the above teachings. It is therefore to be understood that within the scope of the appended claims, the present invention may be practiced otherwise than as specifically described herein.

What is claimed is:

1. A grinding machine comprising:

a bed;

a work head fixed on the bed;

a work spindle rotatably supported by the work head for supporting and rotating a workpiece about a Z-axis;

a slide base mounted on the bed and reciprocatively movable in the Z-direction, wherein the slide base is located below the Z-axis;

a wheel head mounted on the slide base and reciprocatively movable in an X-direction intersecting with the Z-direction;

a rotating grinding wheel carried on the wheel head for grinding a ground portion of the workpiece;

a measuring device engageable with the ground portion of the workpiece ground with the grinding wheel for measuring the dimension of the ground portion;

a support arm cantilever secured to the slide base for movement with the slide base and not the wheel head, the support arm extending its extreme end in the X-direction to a position which is opposite to the grinding wheel with the rotational axis of the work spindle therebetween;

a mechanism provided on the extreme end of the support arm and mounting the measuring device for enabling the measuring device to be brought into engagement with the workpiece from a side of the workpiece opposite to the grinding wheel, wherein the support arm extends in the X-direction to pass over the workpiece being supported on the work spindle; and a support frame taking a gantry shape to straddle over the wheel head and the grinding wheel in the Z direction and having a pair of leg portions secured to the slide base, and wherein the support arm extending in the X-direction is secured to an upper portion of the support frame at its one end opposite to the extreme end, wherein the upper portion of the support frame to which the support arm is secured is on the side of the work head.

2. The mounting structure as set forth in claim 1, wherein the mechanism includes an actuator device for moving the measuring device between a measuring position where the measuring device is engaged with the workpiece and a parked position where the measuring device retracted from the measuring position to go away from the grinding wheel.

3. The mounting structure as set forth in claim 1, wherein the mechanism provided on the extreme end of the support arm enables the measuring device to be moved in the X-direction relative to the support arm.

4. A grinding machine comprising:

a bed;

a work head fixed on the bed;

a work spindle rotatably supported by the work head for supporting and rotating a workpiece about a Z axis;

a slide base mounted on the bed and reciprocatively movable in the Z-direction, wherein the slide base is located below the Z-axis;

a wheel head mounted on the slide base and reciprocatively movable in an X-direction intersecting with the Z-direction;

a rotating grinding wheel carried on the wheel head for grinding a ground portion of the workpiece;

a support arm having a portion cantilever secured to the slide base for movement with the slide base and not the wheel head, the support arm extending its extreme end in the X- direction to a position which is opposite to the grinding wheel with the rotational axis of the work spindle therebetween;

a measuring device supported by the support arm at the extreme end of the support arm; and X-direction positioning means provided at the extreme end of the support arm for moving the measuring device in the X-direction relative to the extreme end of the support arm, to be brought into engagement with the workpiece from a side of the workpiece opposite to the grinding wheel, wherein the support arm extends in the X-direction to pass over the workpiece being supported on the work spindle.

* * * * *